US006902152B1

(12) United States Patent
Clifford et al.

(10) Patent No.: US 6,902,152 B1
(45) Date of Patent: Jun. 7, 2005

(54) ADJUSTABLE FENCE RAIL SUPPORTING AND POSITIONING ASSEMBLY AND METHOD FOR USING THE ASSEMBLY

(76) Inventors: Jeffory Neil Clifford, 1060 Centre Ave., Idaho Falls, ID (US) 83402; Blair J. Sautter, 2268 E. 113 North, Idaho Falls, ID (US) 83401; Dale Kirk Hepworth, 1 N. 3300 East, Rigby, ID (US) 83442; Larry Jacob Stucki, 95 N. 3500 East, Rigby, ID (US) 83442

( * ) Notice: Subject to any disclaimer, the term of this patent is extended or adjusted under 35 U.S.C. 154(b) by 20 days.

(21) Appl. No.: 10/618,501

(22) Filed: Jul. 11, 2003

Related U.S. Application Data

(60) Provisional application No. 60/458,613, filed on Mar. 31, 2003, and provisional application No. 60/395,063, filed on Jul. 12, 2002.

(51) Int. Cl.[7] ..... E04H 17/02
(52) U.S. Cl. ..... 256/47; 256/65.01
(58) Field of Search ..... 256/47, 32, 59, 256/65.01, 65.02, 65.03, 65.04, 19

(56) References Cited

U.S. PATENT DOCUMENTS 1,772,159 A 8/1930 Roth
3,881,698 A * 5/1975 Marsh ..... 256/59
3,920,221 A * 11/1975 Berry et al. ..... 256/59
4,150,907 A 4/1979 Thurnauer
4,923,176 A 5/1990 Heinz
5,360,191 A 11/1994 Carson et al.
6,695,293 B1 * 2/2004 Kamarad et al. ..... 256/48
2002/0179893 A1 12/2002 Salisbury et al.

* cited by examiner

*Primary Examiner*—John R. Cottingham
(74) *Attorney, Agent, or Firm*—Rigby, Thatcher, Andrus, Rigby & Moeller, Chartered

(57) ABSTRACT

The invention includes an assembly for adjustably supporting and positioning a fence rail at a user-selected, user-modifiable elevation and at an user-selected, user-modifiable angle. The assembly includes: A slotted member containing a plurality of uniformly-sized and uniformly-shaped slots spaced at regular intervals along its length and a bracket member including (1) a handle, (2) a first slot-engaging portion detachably insertable into a first slot among the plurality of slots, (3) a second slot-engaging portion detachably insertable into a second slot among the plurality of slots, and (4) a fence rail contacting portion with a fence rail contacting surface.

12 Claims, 7 Drawing Sheets

ADJUSTABLE FENCE RAIL SUPPORTING AND POSITIONING ASSEMBLY AND METHOD FOR USING THE ASSEMBLY

CROSS REFERENCE TO RELATED APPLICATIONS

This application claims priority to Provisional Patent Application No. 60/395,063 filed Jul. 12, 2002 entitled "Fence Post, Standard and Bracket for Flexible Rail Materials" and to Provisional Patent Application No. 60/458,613 filed Mar. 31, 2003 also entitled "Fence Post, Standard and Bracket for Flexible Rail Materials."

TECHNICAL FIELD

This invention relates to an adjustable fence rail supporting and positioning assembly and a method for using the assembly. More specifically, the invention relates to an assembly for adjustably supporting and positioning a fence rail at a user-selected, user-modifiable elevation and at a user-selected, user-modifiable angle.

BACKGROUND OF THE INVENTION

Common techniques for positioning and supporting a fence rail during assembly of a fence are well known. In typical practice, a plurality of fence posts are positioned, each with a lower portion thereof in the ground. Fence rails are then mounted between and to the fence posts by fasteners, the fasteners frequently being screws, bolts, nails or other like mechanical fasteners which are driven, screwed or otherwise inserted through the fence rail.

The formation of a fence and particularly the connecting, positioning and supporting of the fence rails against the fence posts can frequently be a labor-intensive and time-consuming process requiring use of multiple tools. Moreover, a fence rail, once mounted to a fence post using typical means, may be difficult to remove and re-position at a different angle or elevation. Indeed, repeated installation and removal of the same fence post may, in common practice, puncture, damage or deface the fence rail and even the connected fence posts. Yet further, removal and repositioning of a fence rail, even where possible, is often a labor-intensive and time-consuming process requiring use of multiple tools.

There accordingly exists a need for an invention which facilitates rapid, efficient, sturdy, yet easily-modifiable connection and positioning of fence rails along a fence by even a relatively unskilled user at a user-selected, user-modifiable elevation and at a user-selected, user-modifiable angle. A need additionally exists for an invention which accomplishes the foregoing purposes without need of tools or additional fasteners and without damage to the fence post or attached fence rails. The assembly and method of the present invention address those needs.

The present invention has particular utility when used in formation of wind fences and snow fences. The porosity of such fences, i.e., that percentage of the total area beneath a top of a top fence rail and above a top surface of the ground, earth or accumulated snow beneath the fence rail where prevailing wind, or snow driven by prevailing wind encounters no fence rail is an important feature. Fences with too little porosity may be damaged or overturned, while fences with too much porosity provide an ineffective barrier and, consequently, ineffective wind or snow control. Various preferred embodiments of the invention are accordingly designed to position, support and space fence rails having a generally uniform and preselected width in a configuration promoting optimum fence porosity.

SUMMARY OF THE INVENTION

It is an object of this invention to provide an adjustable fence rail supporting and positioning assembly and a method for using the assembly. More specifically, it is an object of this invention to provide an assembly for adjustably supporting and positioning a fence rail at a user-selected, user-modifiable elevation and at a user-selected, user-modifiable angle. The assembly includes: A slotted member containing a plurality of uniformly-sized and uniformly-shaped slots spaced at regular intervals along its length and a bracket member including (1) a handle, (2) a first slot-engaging portion detachably insertable into a first slot among the plurality of slots, (3) a second slot-engaging portion detachably insertable into a second slot among the plurality of slots while the first slot-engaging portion occupies the first slot, and (4) a fence rail contacting portion with a fence rail contacting surface. In various embodiments, the bracket member may additionally include at least one ancillary fence rail support and engagement member.

Another object of this invention is to provide an assembly and method in accordance with the preceding paragraph which facilitates rapid, efficient, sturdy, yet easily modifiable connection and positioning of a fence rail along a fence by even a relatively unskilled user at a user-selected, user-modifiable elevation and at an user-selected, user-modifiable angle.

Another object of this invention is to provide an assembly in accordance with the preceding objects which can be engaged with a fence rail and disengaged therefrom without puncturing, damaging or defacing the fence rail engaged.

Another object of this invention is to provide an assembly in accordance with the preceding objects wherein the elevation and angle of a fence rail positioned and supported along a fence can be easily modified without need of tools, additional fasteners and without damage to either the fence post or the fence rail connected thereto.

Another object of this invention is to provide an assembly with the stability, ease and simplicity of an invention having a minimal number of component parts.

Another object of various embodiments of the present invention is to provide an assembly and method in accordance with the preceding objects wherein the plurality of slots are spaced to allow fence rails supported and positioned thereby to be easily spaced in a configuration that allows optimum fence porosity.

Another object of this invention is to provide an adjustable fence rail supporting and positioning assembly in accordance with the preceding objects which will conform to conventional forms of manufacture, be of comparatively simple construction and easy to use so as to provide an assembly that will be economically feasible, durable and relatively free of trouble in use.

These together with the other objects and advantages of the invention which will become subsequently apparent reside in the details of construction and operation as more fully hereinafter described and claimed, reference being had to the accompanying drawings forming a part hereof, wherein like numerals refer to like parts and portions throughout.

DETAILED DESCRIPTION OF THE INVENTION

Figure 1:
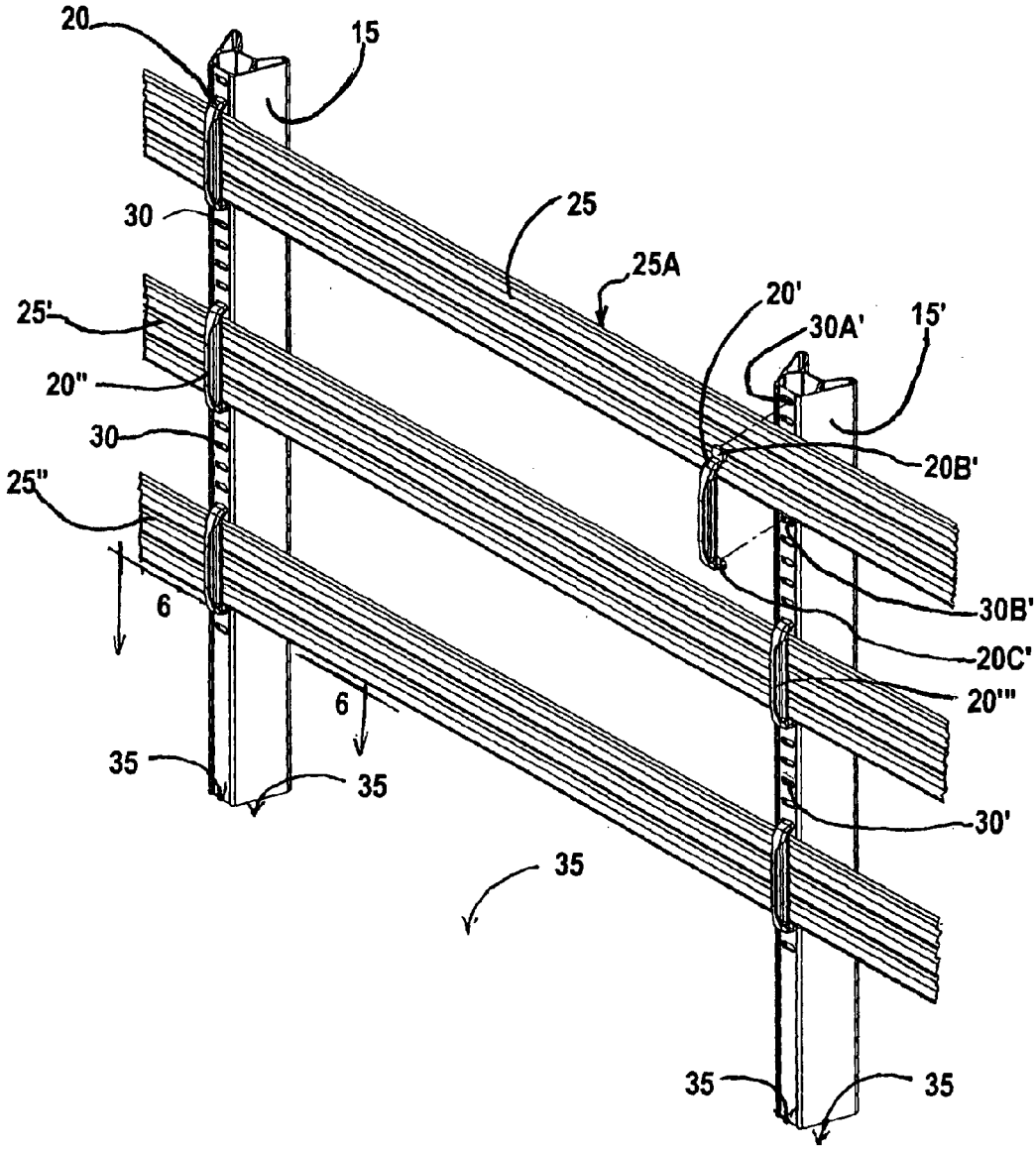
FIG. 1 is a partially exploded perspective view illustrating six bracket members of the assembly of the present invention and two slotted members of the assembly of the present invention, shown supporting and positioning three fence rails.
Figure 2:
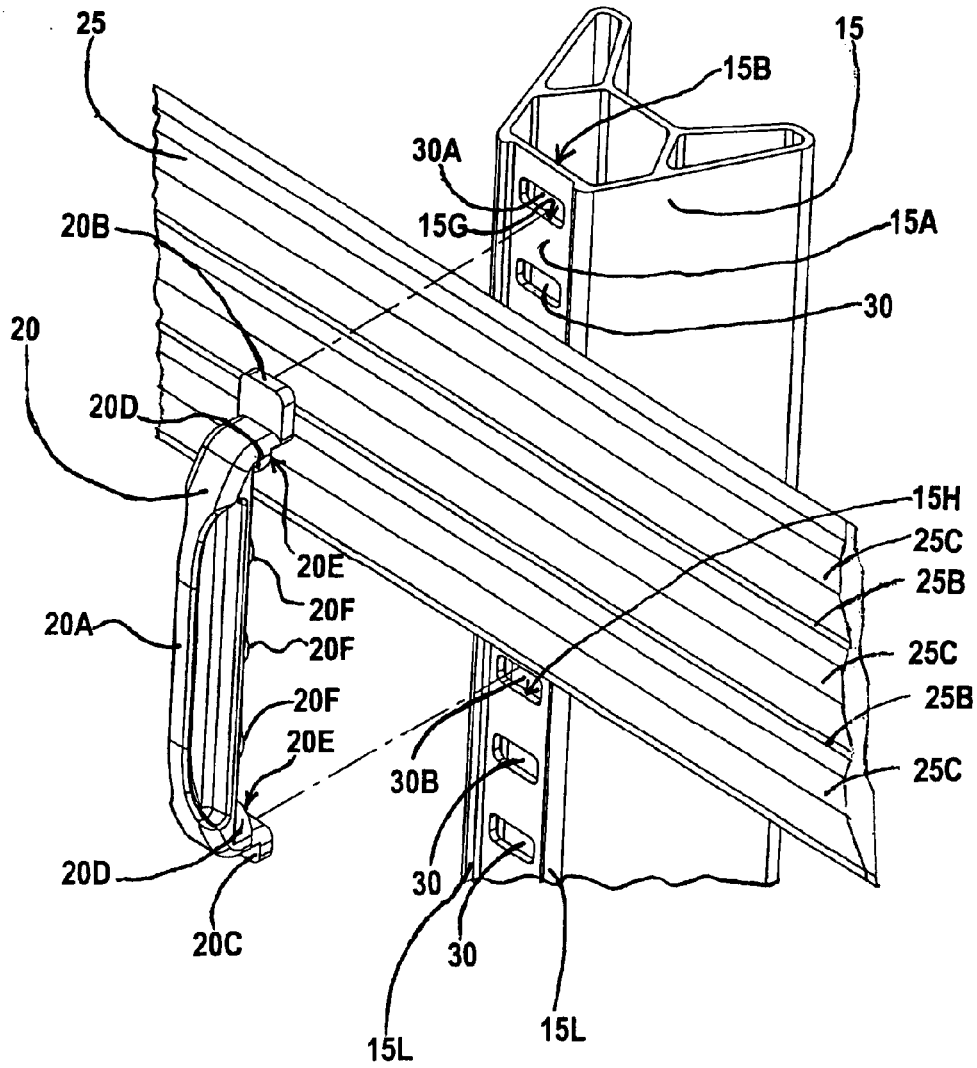
FIG. 2 is a perspective view of a portion of a slotted member of the present invention and a bracket member of the present invention shown with a portion of a fence rail positioned between the slotted member and the bracket member.
Figure 3:
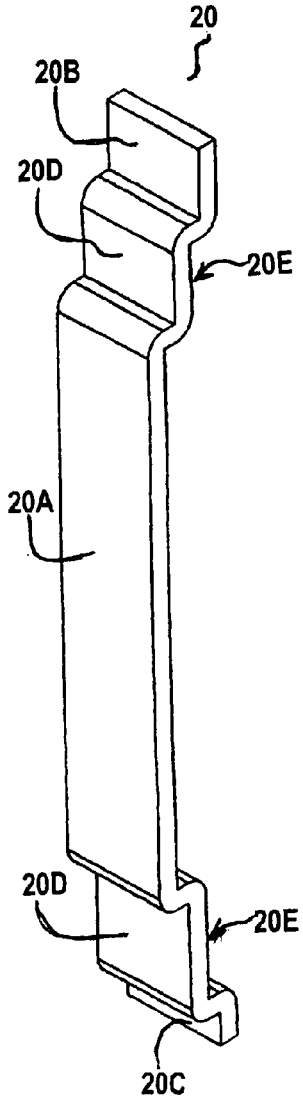
FIG. 3 is a perspective view of an embodiment of the bracket member of the present invention.

FIG. 2 illustrates a preferred embodiment of an adjustable fence rail supporting and positioning assembly, the assembly comprising at least a slotted member 15 and at least a bracket member 20. In standard use, the assembly is used to support and position a fence rail 25 as illustrated in FIG. 1.

Figure 9:
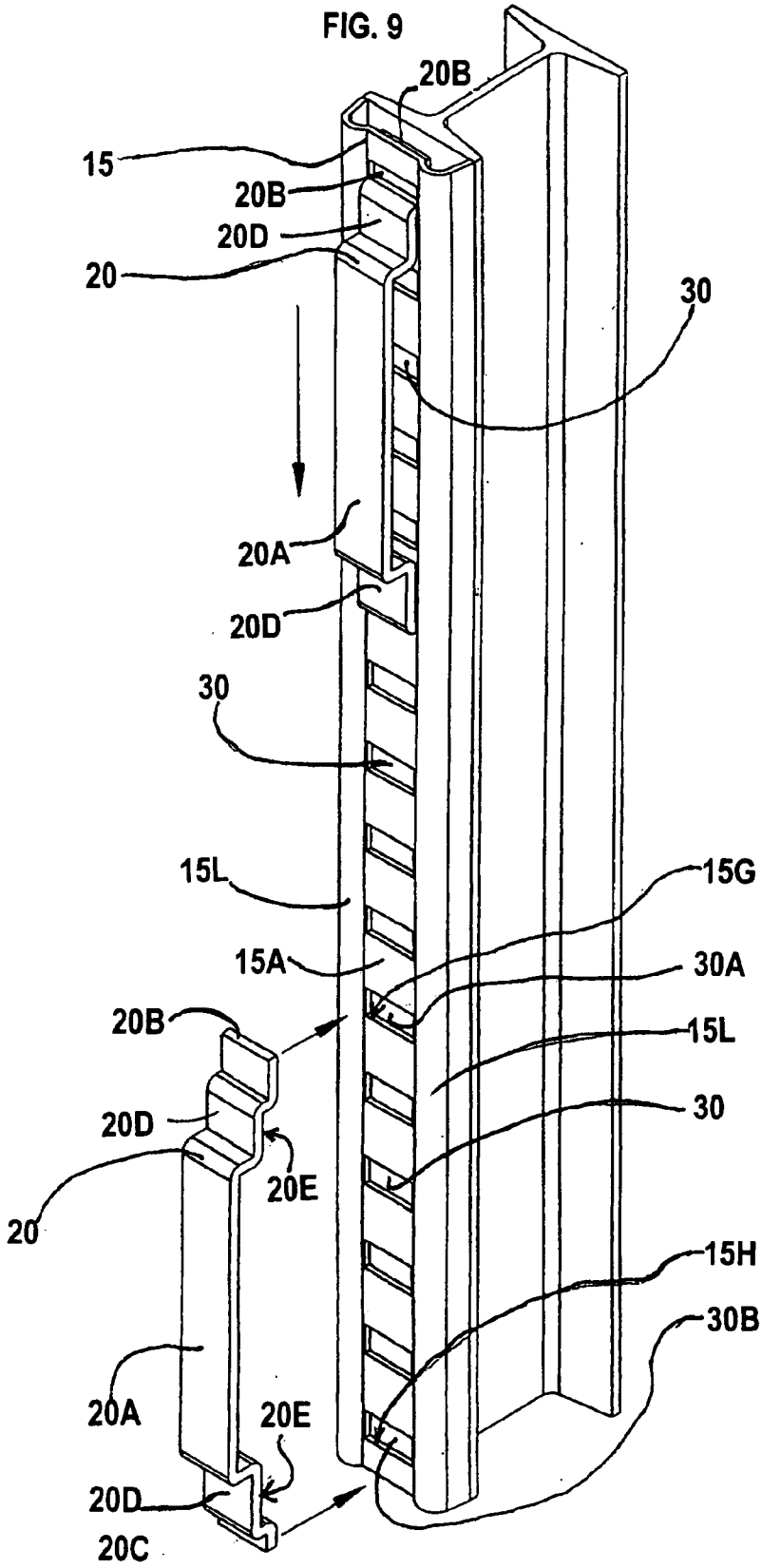
FIG. 9 is a perspective view of an alternative embodiment of the slotted member of the present invention and the bracket member of the present invention.

Referring to FIGS. 1, 2 and 9, a slotted member 15 of a preferred embodiment of the assembly contains a plurality of uniformly-sized and uniformly-shaped non-vertical slots 30 spaced at regular intervals along a length of the slotted member 15 and disposed horizontally through a frontal portion 15A of the slotted member 15. Each slot among the plurality of slots 30 is preferably disposed parallel to other slots among the plurality of slots 30. In preferred embodiments of the slotted member 15, the distance between an edge of a slot most proximate a most proximate edge of a closest, neighboring slot is equivalent for each slot among the plurality of slots 30. In standard use, the plurality of slots 30 accordingly allow for detachable connection of the bracket member 20 at a variety of locations along the vertical dimension of the slotted member 15.

With attention directed to FIGS. 2, 3, 4, 5 and 9, it is seen that the bracket member 20 of the assembly includes: (1) a handle portion 20A gripped by a user during removal and connection of the bracket member 20 to the slotted member 15; (2) a first slot-engaging portion 20B detachably insertable into a first slot 30A among the plurality of slots 30 in the slotted member 15 as best indicated in FIGS. 2 and 9; (3) a second slot-engaging portion 20C detachably insertable into a second slot 30B among the plurality of slots 30 in the slotted member 15 as best indicated in FIGS. 2 and 9, the second slot-engaging portion 20C being spaced at a predetermined distance from the first slot-engaging portion 20B such that the second slot-engaging portion 20C may be detachably inserted into the second slot 30B while the first slot-engaging portion 20B occupies the first slot 30A; and (4) a fence rail contacting portion 20D having a fence rail contacting surface 20E thereon. In the embodiment shown in FIGS. 2, 4 and 5, the bracket member 20 additionally includes at least one ancillary fence rail support and engagement member 20F.

Referring primarily to FIGS. 1, 2 and 9, the first slot-engaging portion 20B and the second slot-engaging portion 20C of the bracket member 20 are insertable into any slot among the plurality of slots 30 and allow for a firm, sturdy yet detachable connection to be formed between the bracket member 20 and the slotted member 15 at a variety of locations along the vertical dimension of the slotted member 15. A user may selectively attach the bracket member 20 to the slotted member 15 at any location among said variety of locations and may thereby form a firm, stable yet detachable connection to clasp, support and position the fence rail 25 against the slotted member 15 at a user-selected elevation without puncturing, damaging or defacing the fence rail 25. By selecting the respective elevations of a plurality of bracket members 20, 20' connected to a plurality of slotted members 15, 15' clasping the same fence rail 25 (as shown in FIG. 1), a user may also select and control the angle of the fence rail clasped, supported and positioned by the plurality of bracket members 20, 20' against the plurality of slotted members 15, 15'. The invention accordingly functions to provide an assembly for clasping, supporting and positioning the fence rail 25 at a user-selected, user-modifiable elevation and at a user-selected, user-modifiable angle.

To facilitate performance of the functions noted in the preceding sentence, the bracket member 20 is designed to easily insert into the slotted member 15 and thereby form a firm, stable yet detachable connection between the bracket member 20 and the slotted member 15. Referring to FIGS. 2, 3, 4, 5 and 9, the first slot-engaging portion 20B includes an L-shaped tab disposed inwardly and upwardly away from a lower remainder of the bracket member 20, the first slot-engaging portion 20B terminating at an upper end of the bracket member 20. Width of the first slot-engaging portion 20B preferably corresponds with a horizontal dimension of each slot among the plurality of slots 30 in the slotted member 15, allowing for a snug connection when the first slot-engaging portion 20B is inserted into the first slot 30A. A maximum length of the first slot-engaging portion 20B exceeds a maximum vertical dimension of each slot among the plurality of slots 30 in the slotted member 15. Thus, after initial angular insertion of the first slot-engaging portion 20B into the first slot 30A and subsequent movement of the bracket member 20 while inserted in the first slot 30A to a position generally parallel to the slotted member 15, the first slot-engaging portion 20B is retained against an interior surface 15B of the slotted member 15 with a surface of the bracket member 20 contacting a first support surface 15G (FIG. 2) of the slotted member 15 bordering a bottom of the first slot 30A and being supported thereby.

The firm, yet detachable connection between the bracket member 20 and the slotted member 15 is facilitated not only by the first slot-engaging portion 20B but also by the second slot-engaging portion 20C of the bracket member 20. Referring to FIGS. 2, 3, 4, 5 and 9, preferred embodiments of the second slot-engaging portion 20C include an inverted L-shaped tab disposed inwardly and downwardly away from an upper remainder of the bracket member 20, the second slot-engaging portion 20C terminating at a lower end of the bracket member 20. The second slot-engaging portion 20C is spaced at a predetermined distance from the first slot-engaging portion 20B such that the second slot-engaging portion 20C is detachably insertable into a second slot 30B among the plurality of slots 30 while the first slot-engaging portion 20B occupies the first slot 30A among the plurality of slots 30. Width of the second slot-engaging portion 20C preferably corresponds with a horizontal dimension of each slot among the plurality of slots 30 in the slotted member 15, facilitating snug connection when the second slot-engaging portion 20C is inserted into the second slot 30B. Preferably, the second slot-engaging portion 20C does not exceed in length any slot among the plurality of slots 30 and may thus be detachably inserted into the second slot 30B among the plurality of slots 30 while the first slot-engaging portion 20B occupies the first slot 30A. Referring to FIGS. 2 and 9, the second slot-engaging portion 20C is retained after insertion into the second slot 30B against the interior surface 15B of the slotted member 15, with a surface of the bracket member 20 contacting a second support surface 15H of the slotted member 15 bordering a bottom of the second slot 30B and being supported thereby.

Referring further to FIGS. 2, 3, 4, 5 and 9, the bracket member 20 includes a fence rail contacting portion 20D having a fence rail contacting surface 20E thereon. The fence rail contacting surface 20E of the fence rail contacting portion 20D functions to contact and engage the fence rail 25 as the fence rail 25 is positioned and supported by the bracket member 20 against the slotted member 15.

Figure 4:
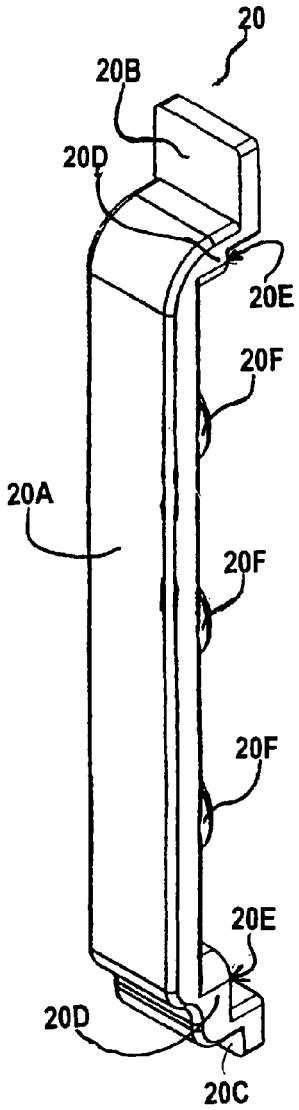
FIG. 4 is a perspective view of an alternate embodiment of the bracket member of the present invention.
Figure 5:
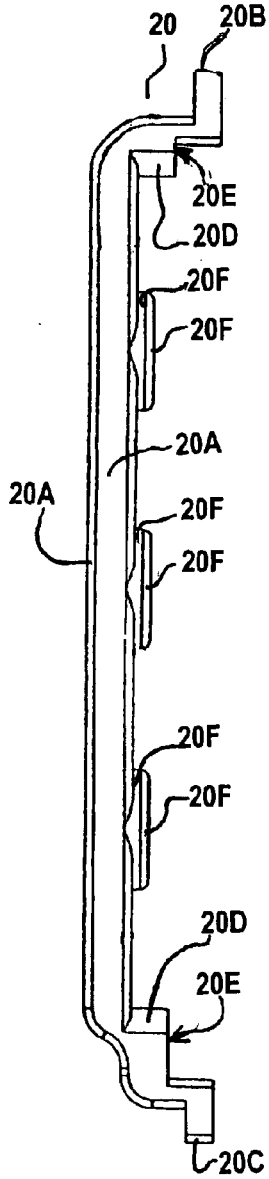
FIG. 5 is a side plan view of the embodiment of the bracket member of FIG. 4.

Referring to FIGS. 2, 4 and 5, the bracket member 20 in the embodiment shown additionally includes at least one ancillary fence rail support and engagement member 20F. The ancillary fence rail support and engagement member 20F functions to provide more complete engagement of, and contact with the fence rail 25 by the bracket member 20, particularly in circumstances where the fence rail 25 presents an uneven face to be engaged and contacted by the bracket member 20. The ancillary fence rail support and engagement member 20F functions not only to extend the bracket member 20 so that the bracket member 20 may contact recessed portions 25B (FIG. 2) in the uneven face of the fence rail 25 but to also contact, engage and provide support to protruding portions 25C (FIG. 2) of the uneven face of the fence rail 25 by contacting the protruding portions 25C of the fence rail 25 from beneath. In the embodiment shown in FIGS. 2, 4 and 5, the ancillary fence rail support and engagement member 20F is circular and thereby presents a convex, curved surface to contact and support protruding portions 25C of the fence rail 25 at multiple potential angles. The engagement member 20F is ideal for supporting, positioning and engaging a polymerized fence rail having generally parallel metallic reinforcement cables (not shown) contained therein, running substantially the length thereof and thereby creating protruding portions 25C running lengthwise along at least a portion of a length of the fence rail 25, though said engagement member's 20F utility is not limited to use with polymerized cable-reinforced fence rails.

Turning to FIGS. 1, 2, 6, 7 and 9, it is seen that in various embodiments of the invention, the slotted member 15 may comprise a fence post. One embodiment illustrated in FIG. 6 includes a hexagonal portion 15I, a first wing portion 15J protruding from an exterior surface of a first wall of the hexagonal portion 15I, a second wing portion 15K protruding from an exterior surface of a third wall of the hexagonal portion 15I, with a fifth wall of the hexagonal portion 15I containing the frontal portion 15A and the plurality of slots 30. In said embodiment, the first wall and the third wall of the hexagonal portion 15I are connected to, and spaced apart by a second wall of the hexagonal portion 15I, the second wall connecting at a first end of the second wall to the first wall and connecting at a second end distal the first end of the second wall to the third wall. The third wall and the fifth wall of the hexagonal portion 15I are similarly connected to, and spaced apart by a fourth wall of the hexagonal portion 15I, the fourth wall connecting at a first end of the fourth wall to the third wall and connecting at a second end distal said first end of the fourth wall to the fifth wall. The fifth wall and the first wall of the hexagonal portion 15I are similarly connected to, and spaced apart by a sixth wall of the hexagonal portion 15I, the sixth wall connecting at a first end of the sixth wall to the fifth wall and connecting at a second end distal the first end of the sixth wall to the first wall.

Figure 6:
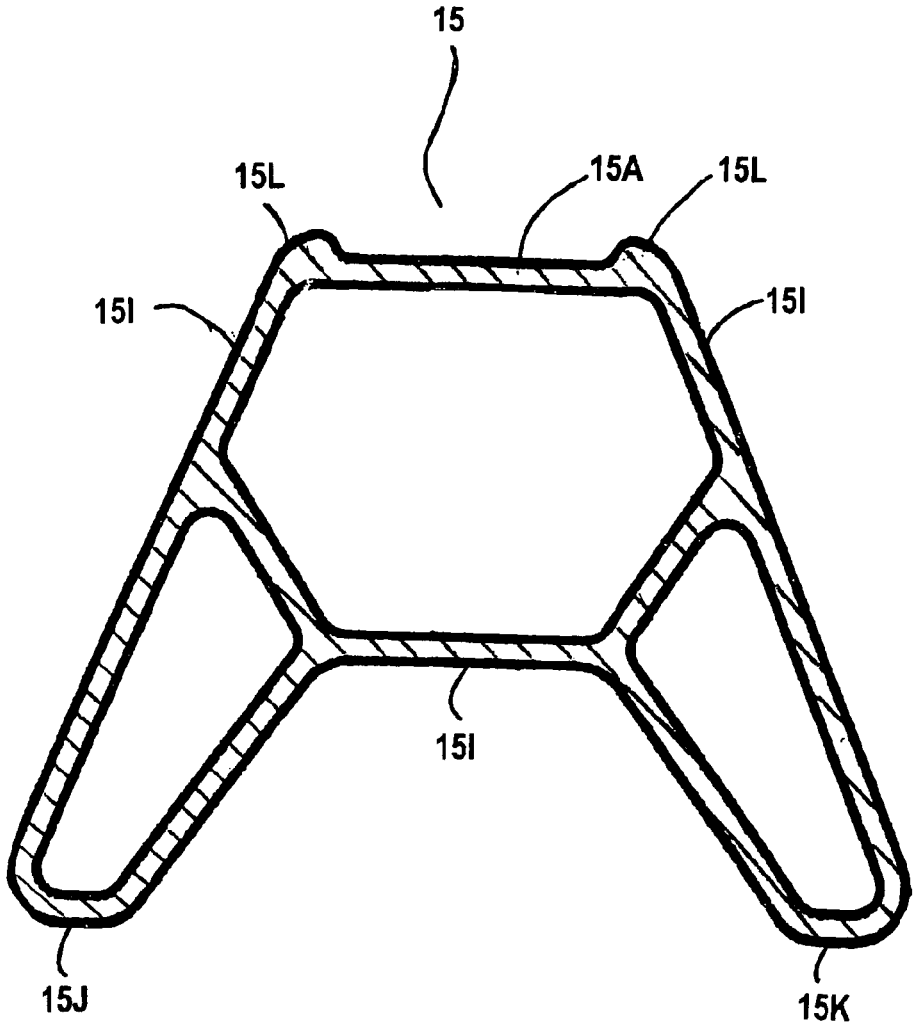
FIG. 6 is a sectional view of the slotted member of the present invention taken through line 6—6 of FIG. 1.
Figure 7:
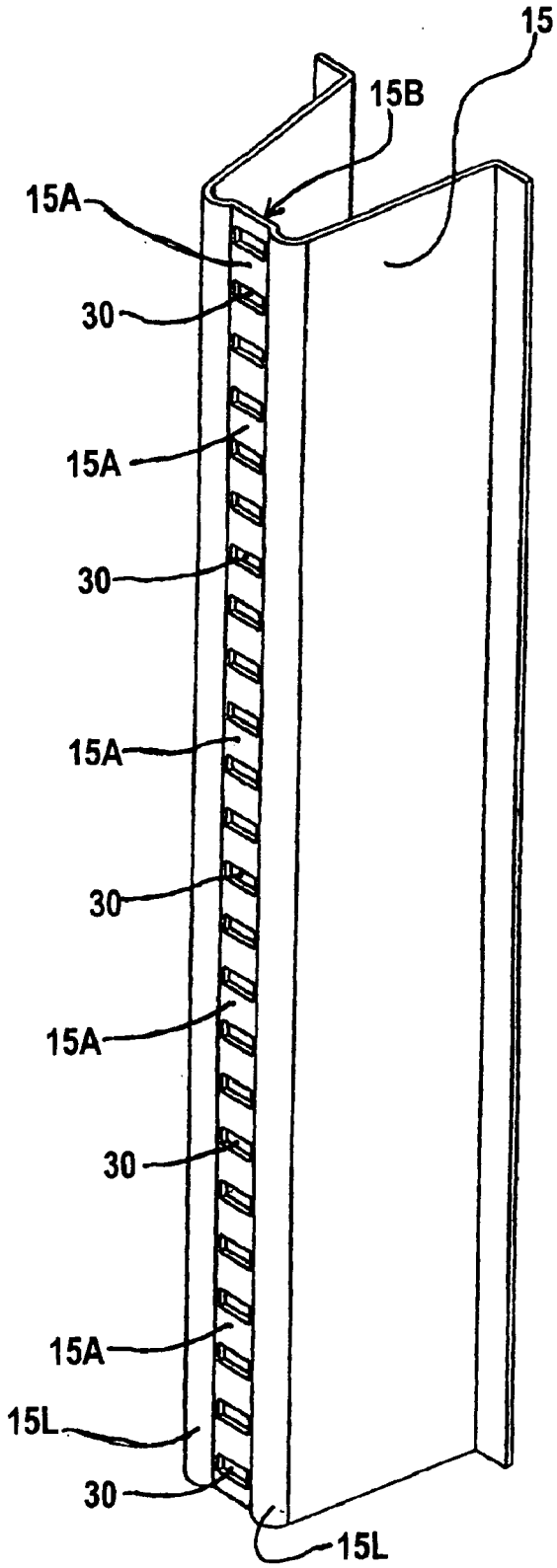
FIG. 7 is a perspective view of an alternative embodiment of the slotted member of the present invention.

Referring further to the embodiment of the slotted member 15 set forth in FIG. 6, a first wing medial wall of the first wing portion 15J connects to the first wall of the hexagonal portion 15I and is disposed away from the first wall toward a curved connection with a first wing lateral wall of the first wing portion 15J, the curved connection being distal from the connection between the first wing medial wall and the first wall of the hexagonal portion 15I. The first wing lateral wall is disposed from the curved connection with the first wing medial wall toward the first wall of the hexagonal portion 15I and connects with an end of the first wall proximate to the sixth wall of the hexagonal portion 15I. An exterior surface of the first wing lateral wall may actually contact an edge of an exterior surface of the sixth wall, thereby forming a smooth, shared exterior surface between the sixth wall of the hexagonal portion 15I and the first lateral wall of the first wing portion 15J.

Referring further to the embodiment shown in FIG. 6, a second wing medial wall of the second wing portion 15K connects to the third wall of the hexagonal portion 15I and is disposed away from the third wall toward a curved connection with a second wing lateral wall of the second wing portion 15K, the curved connection being distal from the connection between the second wing medial wall and the third wall of the hexagonal portion 15I. The second wing lateral wall is disposed from the curved connection with the second wing medial wall toward the third wall of the hexagonal portion 15I and connects with an end of the third wall proximate to the fourth wall of the hexagonal portion 15I. An exterior surface of the second wing lateral wall may actually contact an edge of an exterior surface of the fourth wall, thereby forming a smooth, shared exterior surface between the fourth wall and the second lateral wall of the second wing portion 15K.

The characteristics and structure of the embodiment of the slotted member 15 described above function to economically impart strength and stability. While FIG. 6 illustrates one embodiment of the slotted member 15, it is to be appreciated that said slotted member may take different forms including but not limited to those set forth in FIGS. 7, 8 and 9.

Figure 8:
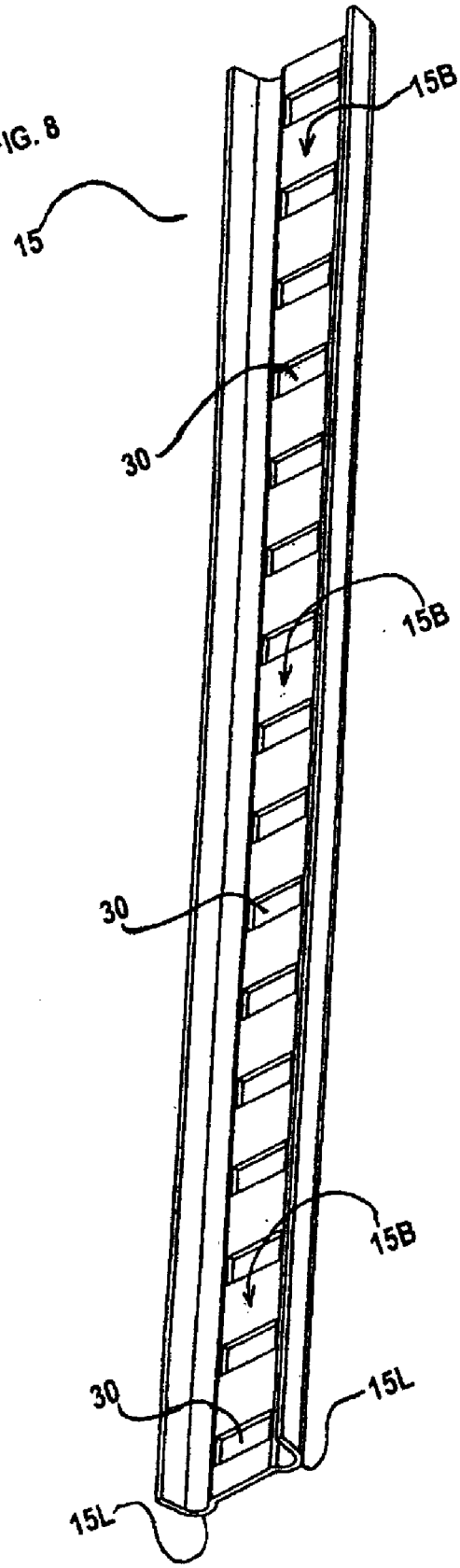
FIG. 8 is a perspective view of an alternative embodiment of the slotted member of the present invention.

With attention directed to FIG. 8, an alternative embodiment of the slotted member 15 is seen. As in the embodiments shown in FIGS. 1, 2, 6, 7 and 9, the slotted member 15 of the assembly contains a plurality of uniformly-sized and uniformly-shaped slots 30 spaced at regular intervals along the length of the slotted member 15 and disposed through a frontal portion 15A of the slotted member. Each slot among the plurality of slots 30 is likewise disposed parallel to other slots among the plurality of slots 30. Moreover, the distance between an edge of a slot most proximate a most proximate edge of a closest, neighboring slot is likewise preferentially equivalent for each slot among the plurality of slots 30. In standard use, the plurality of slots 30 accordingly allow for detachable connection of the bracket member 20 at a variety of locations along the vertical dimension of the slotted member 15. In the alternate embodiment shown in FIG. 8, the slotted member 15 is, however, adapted for connection to an existing fence post which lacks the plurality of slots 30 contained within the slotted member 15, by means for affixing the slotted member 15 to the fence rail, the means for affixing comprising threaded screws (not shown), other fasteners (not shown), adhesive or a combination thereof.

As in the case of embodiments set forth in FIGS. 1, 2, 6, and 9, the frontal portion 15A of the slotted member 15 in FIG. 8 preferably includes a plurality of raised, reinforcement sub-portions 15L, the plurality of raised, reinforcement sub-portions 15L preferably being proximate an edge of the frontal portion 15A, extending the length thereof and protruding therefrom. The plurality of raised, reinforcement sub-portions 15L function not only to further strengthen and stabilize the slotted member 15, but may also contact a portion of the fence rail 25 engaged with the slotted member 15 thereby providing further stability to the connection with the fence rail 25.

When used, the assembly of the present invention provides a convenient method for supporting and positioning one or more fence rails 25, 25', 25" (FIG. 1) at a user-selected, user-modifiable elevation and at a user-selected, user-modifiable angle. With attention directed to FIG. 1, the user first procures (1) at least one fence rail 25, (2) a first adjustable fence rail supporting and positioning assembly having the slotted member 15 and at least one bracket member 20, 20" and (3) at least one additional fence rail supporting and positioning assembly having an additional slotted member 15' and at least one additional bracket member 20', 20'". The user first positions and affixes the slotted member 15 of the first assembly in a generally vertical configuration such that the plurality of slots 30 along the length of the slotted member 15 of the first assembly are spaced at regular, generally vertical intervals. The user likewise positions and affixes the additional slotted member 15' of the additional assembly in a generally vertical configuration at a user-selected distance from the slotted member 15 of the first assembly. When the slotted member 15 or the additional slotted member 15' comprises a fence post or has already been affixed to a fence post, it is preferably positioned and affixed by inserting a lower portion of the fence post into the ground at a location where the user desires the fence post be retained. In circumstances where the slotted member 15 or the additional slotted member 15' does not comprise a fence post or has not already been affixed to a fence post, said positioning and affixing step additionally requires that the slotted member 15 be attached to said fence post, by threaded screws, other fasteners, adhesive, or a combination thereof.

In preferred practice, the user then inserts the first slot-engaging portion 20B of the bracket member 20 of the first assembly in a first slot 30A among the plurality of slots 30 of the slotted member 15 of the first assembly as best shown in FIGS. 2 and 9. The user also positions the fence rail 25 between the bracket member 20 and the slotted member 15 of the first assembly. The user then inserts the second slot-engaging portion 20C of the bracket member 20 of the first assembly into a second slot 30B among the plurality of slots 30 of the slotted member 15 of the first assembly while the first slot-engaging portion 20B occupies the first slot 30A of the slotted member 15 of the first assembly thereby clasping, supporting and positioning the fence rail 25 against the slotted member 15 of the first assembly at a user-selected, user-modifiable elevation.

In preferred practice, the user then inserts an additional first slot-engaging portion 20B' of the additional bracket member 20' of the additional assembly into an additional first slot 30A' among an additional plurality of slots 30' of the additional slotted member 15' of the additional assembly as best seen in FIG. 1. The user also positions the fence rail 25 between the additional bracket member 20' and the additional slotted member 15' of the additional assembly. The user then inserts an additional second slot-engaging portion 20C' of the additional bracket member 20' of the additional assembly into an additional second slot 30B' among the additional plurality of slots 30' of the additional slotted member 15' of the additional assembly while the additional first slot-engaging portion 20B' occupies the additional first slot 30A' of the additional slotted member 15' of the additional assembly thereby clasping, supporting and positioning the fence rail 25 against the additional slotted member 15' of the additional assembly at a user-selected, user-modifiable elevation. It is to be understood that in the preferred embodiments of the assembly the bracket member 20 and all portions thereof are the same in structure, function and dimensions as the additional bracket member 20' and all portions thereof. It is further to be understood that in the preferred embodiment of the assembly the slotted member 15 and all portions thereof are the same in structure, function and dimensions as the additional slotted member 15' and all portions thereof.

The method set forth in the preceding two paragraphs may likewise be used to support and position one or more additional fence rails 25', 25" against the slotted members 15, 15' as seen in FIG. 1. The method set forth in the preceding three paragraphs may likewise be used to support and position the fence rails 25, 25', 25" against further additional slotted members (not shown). Moreover, because the bracket member 20 and the additional bracket member 20' are detachably connected, respectively, to the slotted member 15 and to the additional slotted member 15', the user may modify both the elevation and the angle of the fence rail 25 by simply removing the second slot-engaging portion 20C, 20C' and then the first slot-engaging portion 20B, 20B' of the bracket member 20, 20', respectively, from the second slot 30B, 30B' and the first slot 30A, 30A' and by then re-clasping, re-supporting and re-positioning said fence rail 25 at a different (modified) user-selected elevation and angle following the procedure set forth in the preceding paragraphs.

The assembly and method of the present invention have particular utility when used in the formation wind fences and snow fences having fence rails 25, 25', 25" of a generally uniform and preselected width. Porosity of such fences, being that percentage of the total area beneath a top 25A of a top fence rail 25 (FIG. 1) positioned and supported against the slotted member 15 and above a top surface 35 of the ground (including the earth, accumulated snow or other material) beneath said fence rail 25 (FIG. 1) where prevailing wind, or snow driven by prevailing wind encounters no fence rail 25, 25', 25" is an important feature. Fences with too little porosity may be damaged or overturned, while fences with too much porosity provide an ineffective barrier and, consequently, ineffective wind or snow control.

In various preferred embodiments of the invention, like that shown in FIG. 1, the plurality of slots 30 along the length of the slotted member 15 are accordingly spaced at a determined interval, the determined interval sized to space and configure the fence rail 25 clasped, supported and positioned against the slotted member 15 by the bracket member 20 at a determined, optimum distance from a closest, neighboring fence rail 25' clasped, supported and positioned against the slotted member 15 by a second bracket member 20". The additional plurality of slots 30' along the length of the additional slotted member 15' are likewise spaced at the determined interval to space and configure the fence rail 25 clasped, supported and positioned against the additional slotted member 15' by the additional bracket member 20' at the determined, optimum distance from the closest, neighboring fence rail 25' clasped, supported and positioned against the additional slotted member 15' by an additional second bracket member 20'''.

In various preferred embodiments the determined interval between each of said plurality of slots 30 allows said fence rails 25, 25', 25" of generally uniform and preselected width to be easily configured, supported and positioned to form fences having a preferred porosity of at least 30 percent and but no more than 50 percent for wind fences and having a preferred porosity of at least 45 percent but no more than 50 percent for snow fences. For example, in an embodiment designed for use with fence rails having a width of 6 inches and to facilitate configuration of a fence with 50 percent porosity, the determined interval is sized to space and configure a portion of the fence rail 25 most proximate a closest, neighboring, fence rail 25' at a 6 inch distance from a most proximate portion of the closest, neighboring fence rail 25'. In a particular group of embodiments which may be used in the formation of either a wind fence or a snow fence, the determined interval between each of said plurality of slots 30 facilitates easy configuration of a fence having porosity of 35 percent, and alternative configuration of a fence having a porosity of 50 percent. Said plurality of slots 30 may be labeled, individually or collectively, to further assist the user in rapidly forming a fence of desired porosity.

The foregoing is considered as illustrative only of the principles of the invention. Further, since modifications and changes will readily occur to those skilled in the art, it is not desired to limit the invention to the exact construction and operation shown and described, and, accordingly, all suitable modifications and equivalents may be resorted to, falling within the scope of the invention. The slotted member 15 and the bracket member 20 of the assembly are preferably formed of extruded metal. The materials used in construction of the adjustable fence rail supporting and positioning assembly are aluminum, other metallic elements, metallic alloys, and polymers which provide strength, durability and rust resistance.

What is claimed is:

1. An adjustable fence rail supporting and positioning assembly, said assembly comprising:

a) a slotted member, said slotted member containing a plurality of uniformly-sized and uniformly-shaped non-vertical slots spaced at regular intervals along a length of said slotted member and horizontally disposed through said slotted member;

b) a bracket member, said bracket member including:

i) a handle portion;

ii) a first slot-engaging portion detachably insertable into a first slot among said plurality of slots, said first slot-engaging portion including an L-shaped tab disposed inwardly and upwardly away from a lower remainder of said bracket member, said first slot-engaging portion terminating at an upper end of said bracket member;

iii) a second slot-engaging portion detachably insertable into a second slot among said plurality of slots, said second slot-engaging portion being spaced at a predetermined distance from said first slot-engaging portion such that said second slot-engaging portion may be detachably inserted into said second slot while said first slot-engaging portion occupies said first slot, said second slot-engaging portion including an inverted L-shaped tab disposed inwardly and downwardly away from an upper remainder of said bracket member, said second slot-engaging portion terminating at a lower end of said bracket member;

iv) a fence rail contacting portion having a fence rail contacting surface thereon; and wherein said bracket member detachably connects to said slotted member and clasps, supports and positions a fence rail against said slotted member, without puncturing, damaging or defacing said fence rail, at a user-selected, user-modifiable elevation and at a user-selected, user-modifiable angle.

2. An assembly as in claim 1, wherein said plurality of uniformly-sized and uniformly-shaped slots are spaced at a determined interval along said length of said slotted member, said determined interval sized to space and configure said fence rail clasped, supported and positioned against said slotted member by said bracket member at a determined, optimum distance from an additional fence rail clasped, supported and positioned against said slotted member by a second bracket member.

3. An assembly as in claim 2, wherein said determined interval is sized to configure a fence having porosity of not less than 30 percent but no more than 50 percent.

4. An assembly as in claim 2, wherein said determined interval is sized to configure a fence having porosity of not less than 45 percent but no more than 50 percent.

5. An assembly as in claim 2, wherein said determined interval is sized to configure a fence having porosity of 35 percent and to alternatively configure an alternative fence having a porosity of 50 percent.

6. An adjustable fence rail supporting and positioning assembly, said assembly comprising:

a) a slotted member, said slotted member containing a plurality of uniformly-sized and uniformly-shaped non-vertical slots spaced at regular intervals along a length of said slotted member and horizontally disposed through said slotted member, b) a bracket member, said bracket member including:

i) a handle portion;

ii) a first slot-engaging portion detachably insertable into a first slot among said plurality of slots, said first slot-engaging portion including an L-shaped tab disposed inwardly and upwardly away from a lower remainder of said bracket member, said first slot-engaging portion terminating at an upper end of said bracket member;

iii) a second slot-engaging portion detachably insertable into a second slot among said plurality of slots, said second slot-engaging portion being spaced at a predetermined distance from said first slot-engaging portion such that said second slot-engaging portion may be detachably inserted into said second slot while said first slot-engaging portion occupies said first slot, said second slot-engaging portion including an inverted L-shaped tab disposed inwardly and downwardly away from an upper remainder of said bracket member, said second slot-engaging portion terminating at a lower end of said bracket member;

iv) a fence rail contacting portion having a fence rail contacting surface thereon;

v) at least an ancillary fence rail support and engagement member; and wherein said bracket member detachably connects to said slotted member and clasps, supports and positions a fence rail against said slotted member, without puncturing, damaging or defacing said fence rail, at a user-selected, user-modifiable elevation and at a user-selected, user-modifiable angle.

7. An assembly as in claim 6, wherein said ancillary fence rail support and engagement member has a convex surface to contact and support said fence rail.

8. An assembly as in claim 6, wherein said plurality of uniformly-sized and uniformly-shaped slots are spaced at a determined interval along said length of said slotted member, said determined interval sized to space and configure said fence rail clasped, supported and positioned against said slotted member by said bracket member at a determined, optimum distance from an additional fence rail clasped, supported and positioned against said slotted member by a second bracket member.

9. An assembly as in claim 8, wherein said determined interval is sized to configure a fence having porosity of not less than 30 percent but no more than 50 percent.

10. An assembly as in claim 8, wherein said determined interval is sized to configure a fence having porosity of not less than 45 percent but no more than 50 percent.

11. An assembly as in claim 8, wherein said determined interval is sized to configure a fence having porosity of 35 percent and to alternatively configure an alternative fence having a porosity of 50 percent.

12. An adjustable fence rail supporting and positioning assembly, said assembly comprising:

a) a slotted member, said slotted member containing a plurality of uniformly-sized and uniformly-shaped slots spaced at regular intervals along a length of said slotted member and disposed through said slotted member;

b) a bracket member, said bracket member including:

i) a handle portion;

ii) a first slot-engaging portion detachably insertable into a first slot among said plurality of slots;

iii) a second slot-engaging portion detachably insertable into a second slot among said plurality of slots, said second slot-engaging portion being spaced at a predetermined distance from said first slot-engaging portion such that said second slot-engaging portion may be detachably inserted into said second slot while said first slot- engaging portion occupies said first slot; and iv) a fence rail contacting portion having a fence rail contacting surface thereon; and wherein said bracket member detachably connects to said slotted member and clasps, supports and positions a fence rail against said slotted member, without puncturing, damaging or defacing said fence rail, at a user-selected, user-modifiable elevation and at a user-selected, user-modifiable angle; and wherein said slotted member further comprises:

a) a hexagonal portion;

b) a first wing portion protruding from an exterior surface of a first wall of said hexagonal portion;

c) a second wing portion protruding from an exterior surface of a third wall of said hexagonal portion; and wherein:

i) a fifth wall of said hexagonal portion contains a frontal portion of said slotted member and said plurality of slots;

ii) said first wall and said third wall of said hexagonal portion are connected to, and spaced apart by a second wall of said hexagonal portion, said second wall connecting at a first end of said second wall to said first wall and at a second end distal said first end of said second wall to said third wall;

iii) said third wall and said fifth wall of said hexagonal portion are connected to, and spaced apart by a fourth wall of said hexagonal portion, said fourth wall connecting at a first end of said fourth wall to said third wall and at a second end distal said first end of said fourth wall to said fifth wall; and iv) said fifth wall and said first wall of said hexagonal portion are connected to, and spaced apart by a sixth wall of said hexagonal portion, said sixth wall connecting at a first end of said sixth wall to said fifth wall and at a second end distal said first end of said sixth wall to said first wall.

* * * * *